US009955256B2

(12) United States Patent
Su et al.

(10) Patent No.: US 9,955,256 B2
(45) Date of Patent: Apr. 24, 2018

(54) SPEAKER PROTECTION BASED ON OUTPUT SIGNAL ANALYSIS

(71) Applicant: Cirrus Logic International Semiconductor Ltd., Edinburgh (GB)

(72) Inventors: Jie Su, Austin, TX (US); John L. Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 15/195,674

(22) Filed: Jun. 28, 2016

(65) Prior Publication Data

US 2017/0374457 A1 Dec. 28, 2017

(51) Int. Cl.

*H04R 3/00* (2006.01)
*H04R 29/00* (2006.01)
*H04R 3/04* (2006.01)

(52) U.S. Cl.

CPC ..... *H04R 3/007* (2013.01); *H04R 3/04* (2013.01); *H04R 29/001* (2013.01); *H04R 2430/01* (2013.01)

(58) Field of Classification Search

CPC ..... H04R 3/007; H04R 3/04; H04R 29/001; H04R 2430/01

See application file for complete search history.

(56) References Cited

U.S. PATENT DOCUMENTS 8,989,404 B2 * 3/2015 De Poortere ..... H04R 3/007 381/104
9,161,126 B2 * 10/2015 Su ..... H04R 3/007
9,173,027 B2 * 10/2015 Su ..... H04R 3/007
9,362,878 B1 * 6/2016 Su ..... H03G 3/007
9,607,628 B2 * 3/2017 Gautama ..... G10L 21/0316
2009/0257599 A1 10/2009 Sand et al.
2013/0077796 A1 * 3/2013 Risbo ..... H03G 11/008 381/55

(Continued)

FOREIGN PATENT DOCUMENTS

EP 2773132 A1 9/2014
GB 2522449 A 7/2015
WO 2013182901 A1 12/2013

OTHER PUBLICATIONS

International Search Report and Written Opinion of the International Searching Authority, International Application No. PCT/US2016/039997, dated Mar. 13, 2017.

*Primary Examiner* — Brenda C Bernardi
(74) *Attorney, Agent, or Firm* — Jackson Walker L.L.P.

(57) ABSTRACT

In accordance with embodiments of the present disclosure, a system may include a controller configured to be coupled to an audio speaker, wherein the controller receives an output signal indicative of a physical quantity associated with the audio speaker, compares the output signal to an audio input signal to determine if differences between the output signal and the audio input signal are present indicating at least one of distortion of the output signal, non-linearities of the audio speaker, and overexcursion of the audio speaker, and controls an audio signal communicated from the controller to the audio speaker and based on the audio input signal responsive to determining that differences between the output signal and the audio input signal are present indicating at least one of distortion of the output signal, non-linearities of the audio speaker, and overexcursion of the audio speaker.

8 Claims, 2 Drawing Sheets

(56) References Cited

U.S. PATENT DOCUMENTS

| | | | | |
|---|---|---|---|---|
| 2013/0216049 | A1* | 8/2013 | Wolf | H04R 3/007 381/55 |
| 2014/0241536 | A1* | 8/2014 | Adams | H04R 3/007 381/59 |
| 2014/0254805 | A1 | 9/2014 | Su et al. | |
| 2015/0086025 | A1* | 3/2015 | Oyetunji | H04R 3/007 381/55 |
| 2015/0201294 | A1* | 7/2015 | Risberg | H04R 3/002 381/59 |
| 2015/0215704 | A1* | 7/2015 | Magrath | H04R 9/022 381/55 |
| 2015/0237443 | A1* | 8/2015 | Ronig | H04R 3/007 381/55 |
| 2016/0373871 | A1* | 12/2016 | Ronig | H04R 29/003 |
| 2017/0085986 | A1* | 3/2017 | Tang | H04R 3/007 |
| 2017/0150284 | A1* | 5/2017 | Polleros | H04R 29/003 |

* cited by examiner

SPEAKER PROTECTION BASED ON OUTPUT SIGNAL ANALYSIS

FIELD OF DISCLOSURE

The present disclosure relates in general to audio speakers, and more particularly, to protecting audio speakers from damage.

BACKGROUND

Audio speakers or loudspeakers are ubiquitous on many devices used by individuals, including televisions, stereo systems, computers, smart phones, and many other consumer devices. Generally speaking, an audio speaker is an electroacoustic transducer that produces sound in response to an electrical audio signal input.

Given its nature as a mechanical device, an audio speaker may be subject to damage caused by operation of the speaker, including overheating and/or overexcursion, in which physical components of the speaker are displaced too far a distance from a resting position. To prevent such damage from happening, speaker systems often include control systems capable of controlling audio gain, audio bandwidth, and/or other components of an audio signal to be communicated to an audio speaker.

However, existing approaches to speaker system control have disadvantages. For example, many such approaches model speaker operation based on measured operating characteristics, but employ linear models. Such linear models may adequately model small signal behavior, but may not sufficiently model nonlinear effects to a speaker caused by larger signals.

SUMMARY

In accordance with the teachings of the present disclosure, the disadvantages and problems associated with protecting a speaker from damage have been reduced or eliminated.

In accordance with embodiments of the present disclosure, a system may include a controller configured to be coupled to an audio speaker, wherein the controller receives an output signal indicative of a physical quantity associated with the audio speaker, compares the output signal to an audio input signal to determine if differences between the output signal and the audio input signal are present indicating at least one of distortion of the output signal, non-linearities of the audio speaker, and overexcursion of the audio speaker, and controls an audio signal communicated from the controller to the audio speaker and based on the audio input signal responsive to determining that differences between the output signal and the audio input signal are present indicating at least one of distortion of the output signal, non-linearities of the audio speaker, and overexcursion of the audio speaker.

In accordance with these and other embodiments of the present disclosure, a method may include receiving an output signal indicative of a physical quantity associated with an audio speaker, comparing the output signal to an audio input signal to determine if differences between the output signal and the audio input signal are present indicating at least one of distortion of the output signal, non-linearities of the audio speaker, and overexcursion of the audio speaker, and controlling an audio signal communicated from the controller to the audio speaker and based on the audio input signal responsive to determining that differences between the output signal and the audio input signal are present indicating at least one of distortion of the output signal, non-linearities of the audio speaker, and overexcursion of the audio speaker.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are exemplary and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
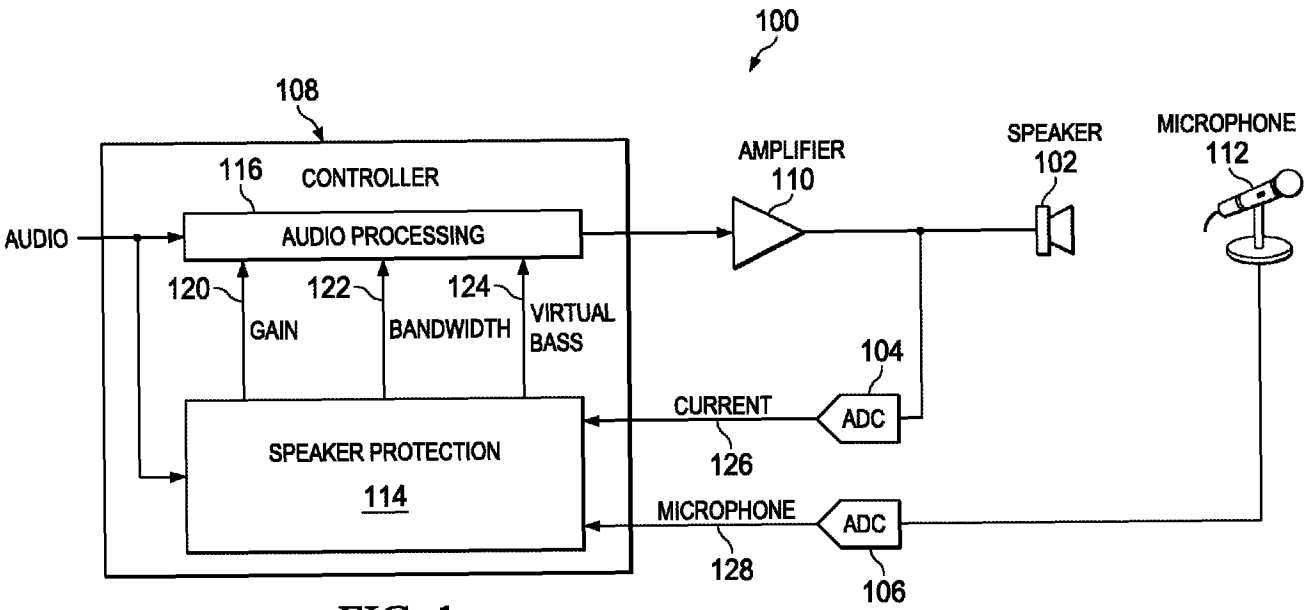
FIG. 1 illustrates a block diagram of an example system that uses output signal analysis to control operation of an audio speaker, in accordance with embodiments of the present disclosure.

FIG. 1 illustrates a block diagram of an example system 100 that employs a controller 108 to control the operation of an audio speaker 102, in accordance with embodiments of the present disclosure. Audio speaker 102 may comprise any suitable electroacoustic transducer that produces sound in response to an electrical audio signal input (e.g., a voltage or current signal). As shown in FIG. 1, controller 108 may generate such an electrical audio signal input, which may be further amplified by an amplifier 110. In some embodiments, one or more components of system 100 may be integral to a single integrated circuit (IC).

Controller 108 may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, controller 108 may interpret and/or execute program instructions and/or process data stored in a memory (not explicitly shown) communicatively coupled to controller 108. As shown in FIG. 1, controller 108 may be configured to perform speaker protection 114 and/or audio processing 116, as described in greater detail below. For example, as shown in FIG. 1, controller 108 may perform audio processing 116 on a digital input audio signal in order to generate an analog signal to be communicated to amplifier 110.

Amplifier 110 may comprise any system, device, or apparatus configured to amplify a signal received from controller 108, amplify the signal by a predetermined gain, and communicate the amplified signal (e.g., to speaker 102). In some embodiments, amplifier 110 may comprise a digital amplifier configured to also convert a digital signal output from controller 108 into an analog signal to be communicated to speaker 102.

The audio signal communicated to speaker 102 may be sampled by an analog-to-digital converter 104 configured to detect an analog current flowing through speaker 102, and convert such analog current measurements into digital current signal 126 to be processed by controller 108.

Microphone 112 may comprise any system, device, or apparatus configured to convert sound incident at microphone 112 to an electrical signal, wherein such sound is converted to an electrical signal using a diaphragm or membrane having an electrical capacitance that varies based on sonic vibrations received at the diaphragm or membrane. Microphone 112 may include an electrostatic microphone, a condenser microphone, an electret microphone, a microelectomechanical systems (MEMs) microphone, or any other suitable capacitive microphone.

The electrical signal generated by microphone 112 may be sampled by an analog-to-digital converter 106 configured to convert such analog electrical signal into digital microphone signal 128 to be processed by controller 108.

Based on digital current signal 126 and digital microphone signal 128, controller 108 may perform speaker protection 114. For example, in some embodiments, speaker protection module 114 may compare digital current signal 126 to the digital input audio signal received by controller 108 to determine differences between the two signals indicative of distortion of the current flowing through speaker 102 and/or any non-linearities of speaker 102 that may cause overexcursion. As another example, in these and other embodiments, speaker protection module 114 may compare digital microphone signal 128 to the digital input audio signal received by controller 108 to determine differences between the two signals indicative of distortion of the current flowing through speaker 102 and/or any non-linearities of speaker 102 that may cause overexcursion.

If speaker protection 114 of controller 108 determines from analysis of digital current signal 126 and/or digital microphone signal 128 that distortion, non-linearities, and overexcursion is present, speaker protection 114 may generate one or more control signals, including without limitation control signals for gain 120, bandwidth 122, and virtual bass 124, and such control signals may be used for audio processing 116. As an example, analysis of digital current signal 126 and/or digital microphone signal 128 by speaker protection 114 may indicate that speaker 102 may generate some distortion and/or non-linearities caused by small overexcursion. In response, speaker protection 114 may control bandwidth 122 in order to filter out lower-frequency components of the audio signal which may reduce displacement of audio speaker 102, while causing virtual bass 124 to virtually add such filtered lower-frequency components to the audio signal. As another example, analysis of digital current signal 126 and/or digital microphone signal 128 by speaker protection 114 may indicate that speaker 102 may generate severe distortion and/or non-linearities caused by large overexcursion. In response, speaker protection 114 may reduce gain 120 in order to reduce the intensity of the audio signal communicated to speaker 102.

Figure 2:
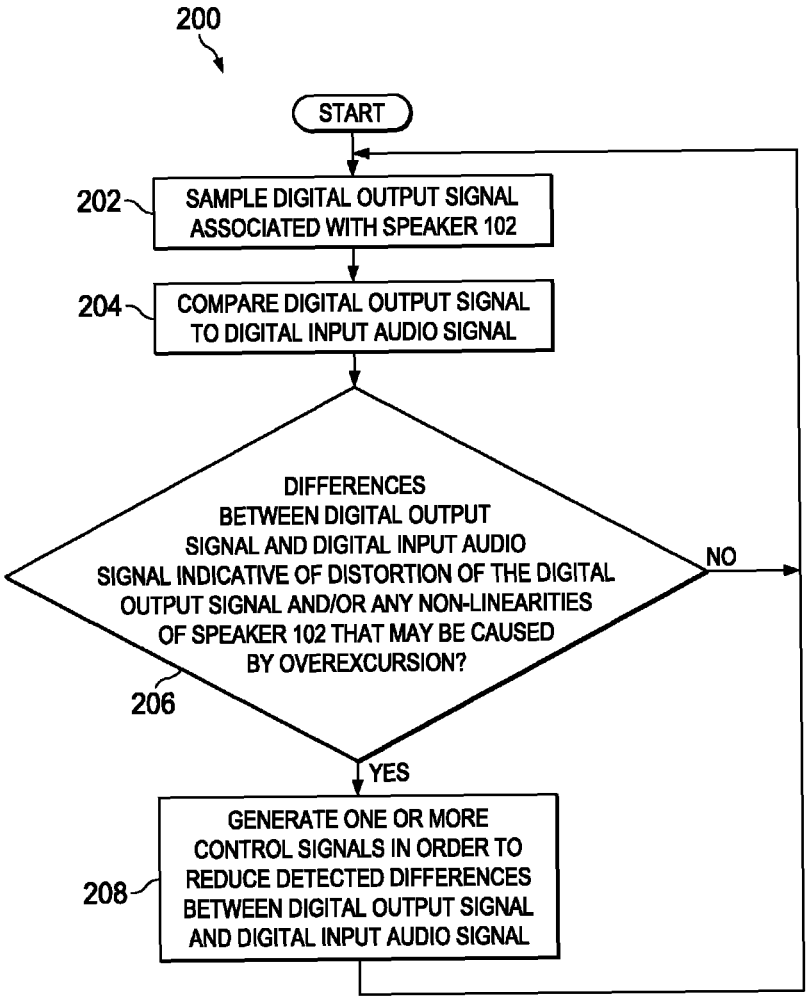
FIG. 2 illustrates a flow chart of an example method for controlling operation of an audio speaker based on output signal analysis, in accordance with embodiments of the present disclosure.

FIG. 2 illustrates a flow chart of an example method 200 for controlling operation of an audio speaker based on output signal analysis, in accordance with embodiments of the present disclosure. According to some embodiments, method 200 may begin at step 202. Teachings of the present disclosure may be implemented in a variety of configurations of system 100. As such, the preferred initialization point for method 200 and the order of the steps comprising method 200 may depend on the implementation chosen.

At step 202, controller 108 may sample a digital output signal indicative of a physical quantity (e.g., current, sound pressure, etc.) of speaker 102. For example, such digital output signal may include a current signal (e.g., current signal 126) or a digital microphone signal (e.g., microphone signal 128), representing a current through a voice coil of speaker 102 or a sound pressure generated by speaker 102 and incident upon microphone 112, respectively.

At step 204, controller 108 may compare the digital output signal to a digital input audio signal. At step 206, controller 108 may, based on such comparison, determine whether differences between the digital output signal and the digital input audio signal indicate distortion of the digital output signal and/or any non-linearities of speaker 102 that may be caused by overexcursion. If differences between the digital output signal and the digital input audio signal indicate of distortion of the digital output signal and/or any non-linearities of speaker 102 that may be caused by overexcursion, method 200 may proceed to step 208. Otherwise, method 200 may proceed again to step 202.

At step 208, speaker protection 114 may generate one or more control signals, including without limitation control signals for gain 120, bandwidth 122, and virtual bass 124, and such control signals may be used for audio processing 116 of the digital input audio signal in order to reduce the detected differences between the digital output signal and the digital input audio signal. After completion of step 208, method 200 may proceed again to step 202.

Although FIG. 2 discloses a particular number of steps to be taken with respect to method 200, method 200 may be executed with greater or fewer steps than those depicted in FIG. 2. In addition, although FIG. 2 discloses a certain order of steps to be taken with respect to method 200, the steps comprising method 200 may be completed in any suitable order.

Method 200 may be implemented using system 100 or any other system operable to implement method 200. In certain embodiments, method 200 may be implemented partially or fully in software and/or firmware embodied in computer-readable media.

This disclosure encompasses all changes, substitutions, variations, alterations, and modifications to the exemplary embodiments herein that a person having ordinary skill in the art would comprehend. Similarly, where appropriate, the appended claims encompass all changes, substitutions, variations, alterations, and modifications to the exemplary embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. A system, comprising:

a controller configured to be coupled to an audio speaker, wherein the controller receives an output signal indicative of a physical quantity associated with the audio speaker, compares the output signal to an audio input signal to determine if differences between the output signal and the audio input signal are present indicating at least one of distortion of the output signal, non-linearities of the audio speaker, and overexcursion of the audio speaker, and controls an audio signal communicated from the controller to the audio speaker and based on the audio input signal responsive to determining that differences between the output signal and the audio input signal are present indicating at least one of distortion of the output signal, non-linearities of the audio speaker, and overexcursion of the audio speaker.

2. The system of claim 1, wherein the controller controls the audio signal communicated from the controller to the audio speaker by controlling at least one of a gain, a bandwidth, and a virtual bass associated with the audio signal.

3. The system of claim 1, wherein the output signal is indicative of a current flowing through the audio speaker.

4. The system of claim 1, wherein the output signal is indicative of a sound pressure generated by the audio speaker.

5. A method comprising:

receiving an output signal indicative of a physical quantity associated with an audio speaker;

comparing the output signal to an audio input signal to determine if differences between the output signal and the audio input signal are present indicating at least one of distortion of the output signal, non-linearities of the audio speaker, and overexcursion of the audio speaker; and controlling an audio signal communicated from the controller to the audio speaker and based on the audio input signal responsive to determining that differences between the output signal and the audio input signal are present indicating at least one of distortion of the output signal, non-linearities of the audio speaker, and overexcursion of the audio speaker.

6. The method of claim 5, wherein controlling the audio signal communicated from the controller to the audio speaker comprises controlling at least one of a gain, a bandwidth, and a virtual bass associated with the audio signal.

7. The method of claim 5, wherein the output signal is indicative of a current flowing through the audio speaker.

8. The method of claim 5, wherein the output signal is indicative of a sound pressure generated by the audio speaker.

* * * * *